US005337809A

United States Patent [19]

Messenger

[11] Patent Number: 5,337,809

[45] Date of Patent: Aug. 16, 1994

[54] WELL CASING LINER SUSPENSION HANGER

[76] Inventor: Jeff Messenger, Rte. 1 Box 174 A-7, Republic, Mo. 65738

[21] Appl. No.: 4,283

[22] Filed: Jan. 14, 1993

[51] Int. Cl.[5] ..... E21B 53/04

[52] U.S. Cl. ..... 166/208; 248/312.1

[58] Field of Search ..... 166/208; 285/140; 248/58, 312.1

[56] References Cited

U.S. PATENT DOCUMENTS 4,014,506 3/1977 Hanson ..... 248/312.1

4,418,883 12/1983 Cohen ..... 248/312.1

5,058,839 10/1991 Stevens ..... 248/97

*Primary Examiner*—William P. Neuder

*Attorney, Agent, or Firm*—Paul M. Denk

[57] ABSTRACT

A suspension hanger for suspending liner pipe inside a well casing for purposes of relining or repair is disclosed having a top annular member to mount on the output end of the casing and a bottom annular member for seating a string of liner pipe. The bottom member is suspended from the top member by suspension strips. The length of the devise and therefore the depth of suspension of the liner pipe can be varied by adding or deleting suspensions strips.

11 Claims, 2 Drawing Sheets

WELL CASING LINER SUSPENSION HANGER

BACKGROUND OF THE INVENTION

This invention relates to a pipe suspension hanger, more specifically to a suspension hanger that allows a liner pipe to be suspended at any given depth inside a well casing or other pipe for the purpose of lining or repair.

In a pipe, or well casing, for example in a water well, that has developed a leak in the existing casing, it is desirable to repair or reline the casing rather than drill a new well and install an entire new casing.

Existing methods of relining or repairing a well casing can be cumbersome, require elaborate or complicated tools or mechanisms, and can be difficult and expensive.

Various devices have been used to repair well casings and the like. U.S. Pat. No. 1,506,881 to Broberg discloses a cave packer for oil, gas, or water wells used for introducing a liner.

U.S. Pat. No. 4,465,133 to Bridges, discloses a hanger collet for suspending a mud line casing.

U.S. Pat. No. 4,458,534 to Lindsey, Jr., discloses a liner hanger assembly that is passed down into the pipe.

U.S. Pat. No. 4,619,326 to van Mierlo, discloses a liner hanger that contains a brass sleeve that functions to maintain the annular seal in a casing string.

U.S. Pat. No. 4,942,924 to Duncan discloses a liner setting assembly including a cone and cage that is complex and has a multiplicity of parts including grips to secure it to the inside of the casing.

SUMMARY OF THE INVENTION

It is an object of the present invention to provide a hanger for suspending liner inside a well casing that is attached or seated on the output end of the pipe and suspends liner pipe downwardly within the casing.

Another object of the present invention is to provide a hanger device that can be lengthened or shortened so as to suspend the liner pipe at any desired depth within the casing.

Yet another object of the present invention is to provide a liner hanger mechanism that is removable if so desired.

Still another object of the present invention is to provide a liner hanger that has a limited number of parts, is economical to construct, is easy to use, and well suited for its intended purpose.

Briefly stated, a well casing liner suspension device having an annular member or collet mountable to the output end of the casing, a second annular member that seats the liner pipe that is to be suspended within the casing, the second annular member or collet being connected to the first annular member by suspension strips. The distance between the first and second annular members can be increased or decreased by adding or removing suspension strips thereby adjusting the depth at which the liner pipe is suspended within the casing.

DESCRIPTION OF THE PREFERRED EMBODIMENT

Figure 1:
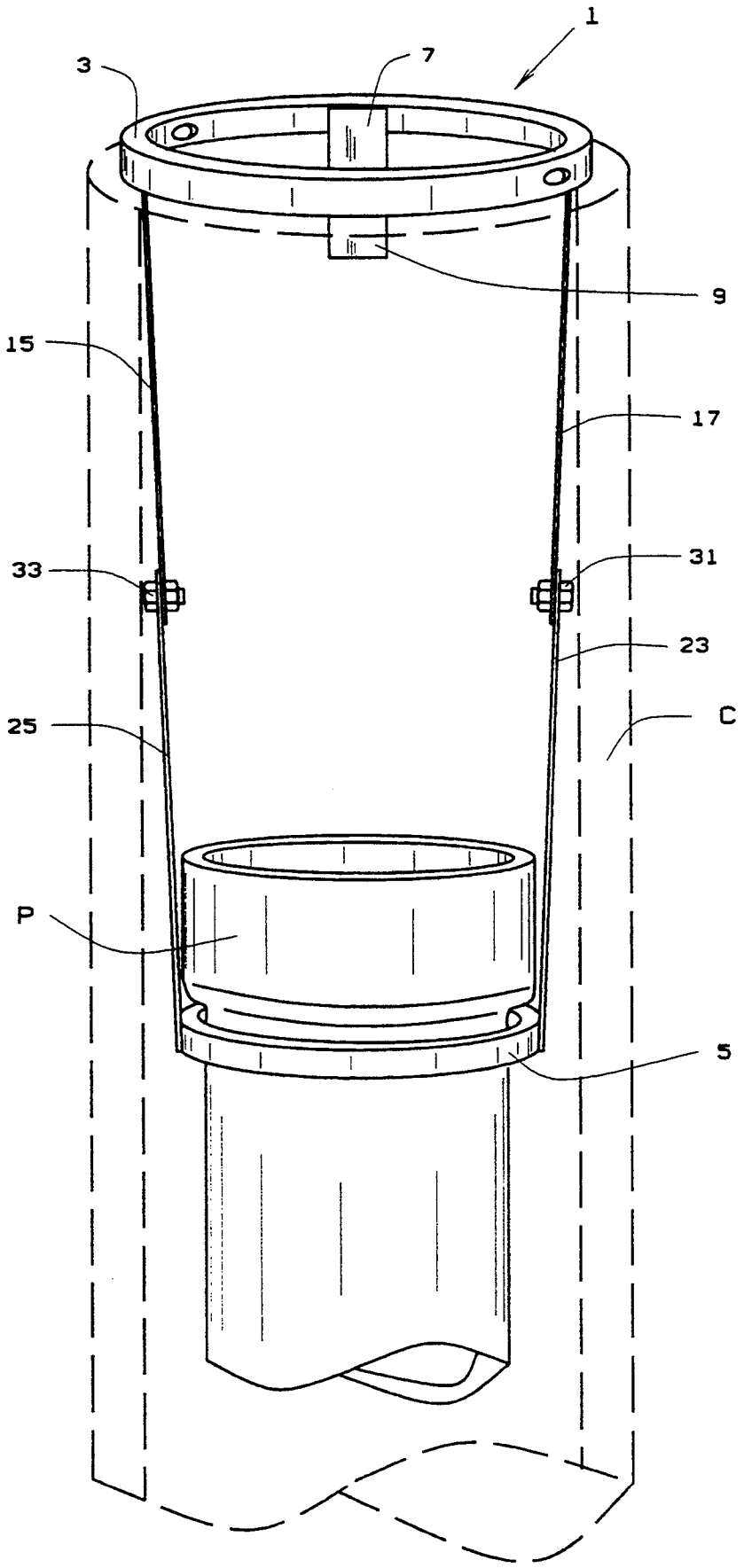
FIG. 1 is a perspective view of the present invention installed in a well casing, the casing shown in phantom to show environment.

Referring now to the drawings, a liner suspension device is shown generally at 1. Device 1 is used, for example, in a well casing such as a water well casing C. The device has a first annular member or collet 3 and a second annular member or collet 5. Collet 5 is designed to seat a liner pipe P and may be constructed with any diameter so as to properly seat and secure such liner pipe P. The diameter of liner pipe P and, therefore, the diameter of collet 5 will vary depending upon the diameter of the casing C to be relined or repaired.

Specifically, first member, or top collet 3 can be constructed or formed from any appropriate material, for example, steel. The diameter of collet 3 can vary depending upon the diameter of casing C. Collet 3 is essentially a band, the height and thickness being variable depending upon the required strength of collet 3. That is, the greater the weight of liner pipe P suspended from collet 3, the greater the mass of collet 3. As shown in FIG. 1, collet 3 can rest upon the upper output end of casing C and be held in place by gravity or collet 3 can be attached to casing C in any appropriate or convenient manner.

Figure 2:
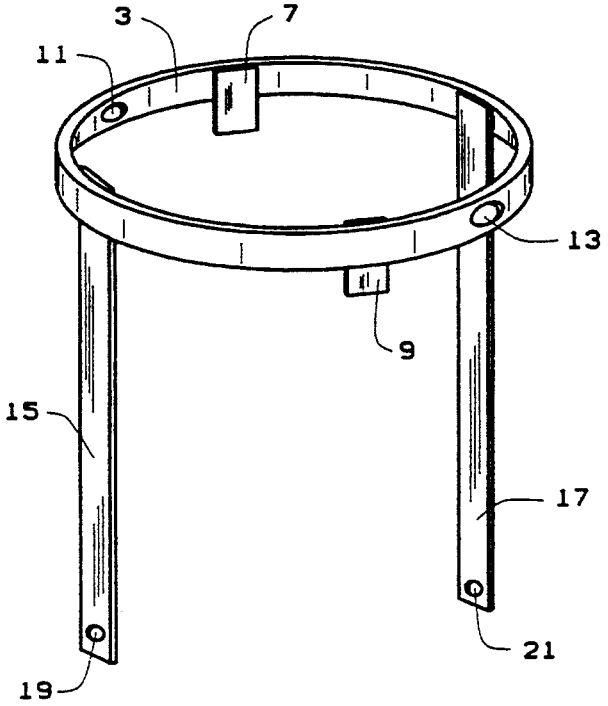
FIG. 2 is a perspective view of the top annular member of the liner suspending device.

Referring now to FIG. 2, collet 3 has guides 7 and 9 welded or suitably secured thereto. Guides 7 and 9 function to align collet 3 on the output end of casing C by resting against the internal face of casing C as shown in FIG. 1. Guides 7 and 9 serve to center collet 3 over the output end of casing C and also serve to laterally stabilize collet 3 when collet 3 is held in place only by gravity.

Collet 3 has holes 11 and 13 formed therein to facilitate insertion or removal of the device from the casing. A suitable tool, chain, or hooks can be inserted through holes 11 and 13 so that device 1 can be lifted onto casing C for installation or pulled from the casing for removal.

Collet 3 has, in this embodiment, two suspension strips 15, 17 permanently affixed thereto. It should be noted that strips 15 and 17 could be removably bolted or pinned to collet 3 without departing from the spirit of the invention. It should also be noted that the overall length, width and thickness of suspension strips 15 and 17 may vary as needed. Strips 15 and 17 have bolt holes 19 and 21 respectively formed therein so as to provide a way to attach additional suspension strips in sequence therefrom as will be explained hereinafter.

Figure 3:
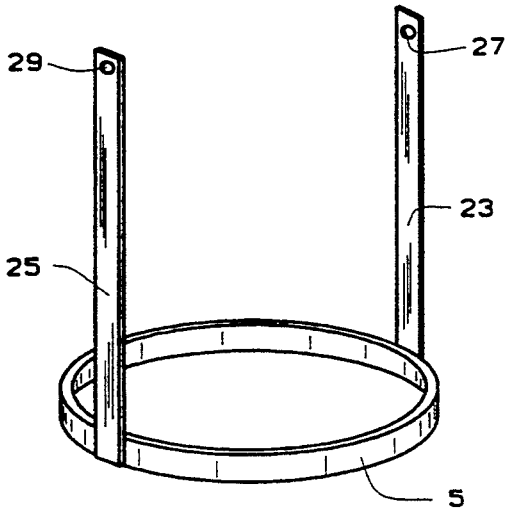
FIG. 3 is a perspective view of the bottom annular member of the liner suspending device of the present invention.

Turning now to the second annular member or collet 5, as best illustrated in FIG. 3. Collet 5 is essentially a circular band and formed from suitable material, such as steel. The height and thickness of collet 5 will vary depending upon the required strength. For example, the greater the weight of liner string to be suspended, the greater the mass of collet 5.

The diameter of collet 5, as previously explained, is variable depending upon the diameter of pipe P (FIG. 1) to be seated therein. Collet 5 has strips 23 and 25 affixed thereto. The strips 23 and 25 can be permanently affixed, as illustrated, or can be removably affixed to collet 5 with suitable bolts or pins, or other means. The overall length, width and thickness of strips 23 and 25 may vary as desired. Strips 23 and 25 have holes 27 and 29, respectively, formed therein so as to allow attachment to strips 15 and 17 with bolt assemblies 31 and 33 as illustrated in FIG. 1 are with pins or other appropriate connecting means. Hole 27 and 29 also allow for the attachment of additional suspension strips as will be explained.

Figure 4:
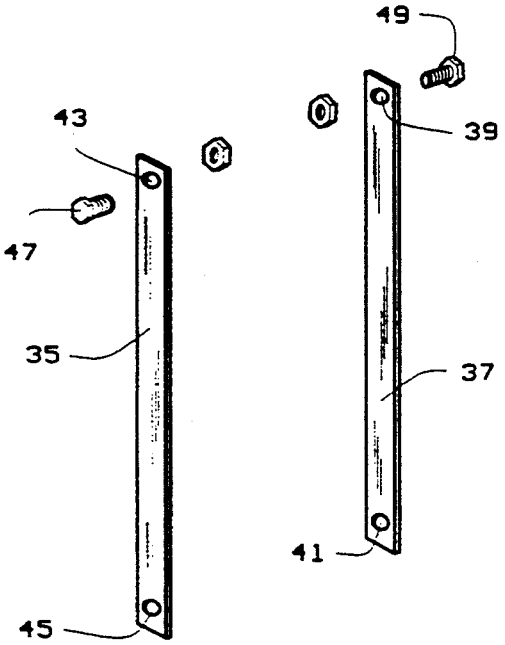
FIG. 4 is a perspective view of the suspension strips of the liner suspension device of the present invention.

FIG. 4 illustrates additional extension strips 35 and 37 having holes 39, 41, and 43, 45, respectively formed therein. Strips 35 and 37 can be made of any appropriate material, for example, steel. The strips may vary in length, width and thickness as desired. Strips 35 and 37 are formed to be attachable between strips 17 and 23 or 15 and 29, for example, with appropriate connecting means such as nut and bolt assemblies, shown for illustrative purposes only at 47 and 49, or pins or other appropriate connecting means. It should be understood that strips 35 and 37 represent a plurality of such strips, all identical, that can be bolted or attached end-to-end and between strips 19, 21, and 27, 29 so as to create a string of suspension strips the desired length. By adding strips, the distance between collet 3 and collet 5 can be increased so that pipe P seated in collet 5 can be positioned at any desired depth inside casing C.

In use, the desired depth of placement of pipe P is determined in the appropriate number of suspension strips, such as 35 and 37, are attached end-to-end between the collets. Pipe P is seated in collet 3 and the entire device is lowered into casing C until collet 3 rests on the output end of casing C. The length of strip 35 and 37, the method of fastening the strips end-to-end, the materials of which the strips and collets are formed as well as the overall dimensions of the strips and collets as disclosed herein are merely illustrative. While the invention has been illustrated and described in detail in the drawings and foregoing description, it will be recognized that many changes and modifications will occur to those skilled in the art. It is therefore intended, by the appended claims, to cover any such changes and modifications as fall within the spirit and scope of the invention.

Having thus described the invention, what is claimed and desired to be secured by Letters Patent is:

1. A pipe suspension hanger, comprising:

a first annular member, said annular member disposed to attach to the upper portion of a well case;

a second annular member, said second annular member being the appropriate diameter so as to seat liner pipe therein and fit within the well casing; and two or more suspension strips, said suspension strips being attachable to said first annular member and attachable to said second annular member by appropriate means thereby allowing said second annular member with said well seated liner pipe therein, to suspend downwardly inside said well casing from said first annular member thereby relining said casing.

2. A pipe suspension hanger, comprising:

a first annular member, said annular member disposed to attach to the upper portion of a well casing;

a second annular member, said second annular member being the appropriate diameter so as to fit within the well casing and to seat liner pipe therein;

two or more suspension strips, said suspension strips being attachable to said first annular member and attachable to said second annular member by appropriate means thereby allowing said second annular member with said well seated liner pipe therein, to suspend downwardly within said well casing form said first annular member thereby relining said casing, a plurality of said suspension strips can be attached in sequence by appropriate means between said first and second annular members thereby increasing the distance between said first and second annular members.

3. The invention of claim 2 wherein the plurality of strips are attached in sequence by bolt assemblies.

4. The invention of claim 2 wherein the plurality of strips are attached in sequence by a suitable pin.

5. The invention of claim 3 further comprising means for removing said device from said well casing.

6. The invention of claim 5 further comprising means for centering said first annular member over the output end of said well such casing.

7. The invention of claim 5 wherein said means for centering said first annular member over the well casing comprises alignment guides, said guides disposed so as to seat within the inner diameter of the output end of said well casing thereby centering said annular member over the well casing.

8. In a well pipe, a device for suspending a liner pipe within said well pipe, comprising:

a first annular member disposed to rest on the output end of said well pipe;

a second annular member, said second annular member disposed to fit within said well pipe and to suspend such liner pipe therein; and suspension strips connecting said second annular member to said first annular member with appropriate means thereby suspending said second annular member holding said liner pipe below said first annular member inside said well pipe.

9. In a well pipe, a device for suspending a liner pipe within said well pipe, comprising:

a first annular member disposed to rest on the output end of said well pipe;

a second annular member, said second annular member disposed to fit within said well pipe and to suspend such liner pipe therein;

suspension strips connecting said second annular member to said first annular member with appropriate means thereby suspending said second annular member holding said liner pipe below said first annular member inside said well pipe;

means for lining said first annular member on the output end of said well pipe.

10. A liner hanger assembly for use in hanging a tubular string of liner pipe in a tubular casing in a well bore comprising:

a first annular member disposed to be attached to the output end of said tubular casing;

a second annular member, said second annular member formed to fit within the tubular casing and further formed to seat a string of said liner pipe therein; and two or more suspension strips, said suspension strips being attachable by appropriate means between said first and second annular members thereby suspending said second annular member and string of liner pipe from said first annular member downwardly inside said casing.

11. A liner hanger assembly for use in hanging a tubular string of liner pipe in a tubular casing in a well bore comprising:

a first annular member disposed to be attached to the output end of said tubular casing;

a second annular member, said second annular member formed to fit within the tubular casing and further formed to seat a string of said liner pipe therein;

two or more suspension strips, said suspension strips being attachable by appropriate means between said first and said second annular members thereby suspending said second annular member and string of liner pipe from said first annular member downwardly inside said casing; and said suspension strips can be attached in sequence by appropriate means thereby increasing the distance between said first annular member and said second annular member.

* * * * *

UNITED STATES PATENT AND TRADEMARK OFFICE

CERTIFICATE OF CORRECTION

PATENT NO. : 5,337,809

DATED : August 16, 1994

INVENTOR(S) : Jeff Messenger

It is certified that error appears in the above-identified patent and that said Letters Patent is hereby corrected as shown below:

Column 4, claim 6, line 15, delete "such".

Signed and Sealed this

Twenty-fifth Day of October, 1994

*Attest:*

*Attesting Officer*

Bruce Lehman

BRUCE LEHMAN

*Commissioner of Patents and Trademarks*